US007775893B2

(12) United States Patent
Blumenthal

(10) Patent No.: US 7,775,893 B2
(45) Date of Patent: Aug. 17, 2010

(54) CHILDREN'S RIDING DEVICE

(75) Inventor: Martin Blumenthal, Chatham, NJ (US)

(73) Assignee: Moose Mountain Toymakers Ltd., Hong Kong (CN)

( * ) Notice: Subject to any disclaimer, the term of this patent is extended or adjusted under 35 U.S.C. 154(b) by 464 days.

(21) Appl. No.: 11/821,539

(22) Filed: Jun. 22, 2007

(65) Prior Publication Data

US 2008/0132343 A1 Jun. 5, 2008

Related U.S. Application Data

(60) Provisional application No. 60/815,939, filed on Jun. 23, 2006.

(51) Int. Cl.
*A63G 13/08* (2006.01)
*A63G 13/00* (2006.01)

(52) U.S. Cl. ..... 472/95; 472/103

(58) Field of Classification Search ..... 472/95–105, 472/135; 280/1.13; 482/75–79
See application file for complete search history.

(56) References Cited

U.S. PATENT DOCUMENTS

| | | | | |
|---|---|---|---|---|
| 974,194 | A | 11/1910 | Schulze | |
| D94,767 | S | 3/1935 | Joutras | |
| 2,554,045 | A * | 5/1951 | Minor, Jr. | 472/99 |
| 2,726,845 | A * | 12/1955 | Hyslop, Jr. et al. | 254/131 |
| 2,743,104 | A | 4/1956 | Dodson | |
| 2,746,754 | A | 5/1956 | Martel | |
| 2,832,594 | A | 4/1958 | Kight et al. | |
| 2,862,710 | A | 12/1958 | Lewis | |
| 2,871,016 | A | 1/1959 | Rapaport | |
| 2,914,325 | A | 11/1959 | Cox | |
| 2,992,009 | A | 7/1961 | Dimitriadis | |
| 2,995,377 | A | 8/1961 | Miihlroth | |
| 2,996,298 | A | 8/1961 | Grosse | |
| 3,080,165 | A | 3/1963 | Wyman | |
| 3,103,356 | A | 9/1963 | Heines | |
| 3,119,626 | A | 1/1964 | Strader | |
| 3,122,377 | A | 2/1964 | Mortenson | |
| 3,138,376 | A | 6/1964 | Ryan | |
| 3,180,640 | A | 4/1965 | Lawrence | |
| 3,220,726 | A | 11/1965 | Koller et al. | |
| 3,237,938 | A | 3/1966 | Koller et al. | |
| 3,467,375 | A | 9/1969 | Bush | |
| 3,522,953 | A | 8/1970 | Gold et al. | |
| 4,093,198 | A | 6/1978 | Petersen et al. | |
| 4,351,521 | A | 9/1982 | Erdos | |
| 4,548,379 | A | 10/1985 | Seely et al. | |
| 4,569,499 | A | 2/1986 | Seely | |
| 4,575,072 | A | 3/1986 | Russell | |
| 4,593,879 | A | 6/1986 | Seely et al. | |
| 4,691,892 | A | 9/1987 | Grewe et al. | |
| 4,728,087 | A | 3/1988 | Wils et al. | |

(Continued)

*Primary Examiner*—Kien T Nguyen
(74) *Attorney, Agent, or Firm*—Lerner, David, Littenberg, Krumholz & Mentlik, LLP

(57) ABSTRACT

A riding device for a child is disclosed, as are different embodiments relating to same. The device preferably includes a seat portion and a base portion, where the seat portion is capable of up and down bouncing motion and forward and back rocking motion. This is preferably achieved by providing the base portion with one or more springs which act to counteract or provide force to the seat portion during operation by a child. The device is capable of being modified to provide different types of movement/motion and to emulate different objects.

34 Claims, 12 Drawing Sheets

U.S. PATENT DOCUMENTS

| | | | | |
|---|---|---|---|---|
| 4,863,138 | A | 9/1989 | Dicke et al. | |
| 4,874,163 | A | 10/1989 | Chiavetta et al. | |
| 4,989,856 | A | 2/1991 | Shieh et al. | |
| 5,152,719 | A | 10/1992 | Nolan | |
| 5,328,410 | A | 7/1994 | Amburgey et al. | |
| 5,509,871 | A | 4/1996 | Giovanni | |
| 5,522,772 | A | 6/1996 | Chenard et al. | |
| 5,878,519 | A | 3/1999 | Huyck, Jr. et al. | |
| 5,980,432 | A | 11/1999 | Ahman | |
| 6,056,250 | A | 5/2000 | Hillstrom et al. | |
| 6,120,375 | A | 9/2000 | Takahashi et al. | |
| 6,210,167 | B1 | 4/2001 | Nishiyama et al. | |
| 6,210,286 | B1 | 4/2001 | Ohara et al. | |
| 6,390,956 | B1 | 5/2002 | Seelye et al. | |
| 6,604,719 | B1 | 8/2003 | Dicke et al. | |
| D491,614 | S | 6/2004 | Arginsky | |
| D493,497 | S | 7/2004 | Arginsky | |
| 6,773,768 | B2 | 8/2004 | Weiser | |
| 6,835,141 | B2 | 12/2004 | Eaves | |
| 7,222,866 | B1 * | 5/2007 | Cahoj et al. | 280/33.991 |
| 2003/0045405 | A1 | 3/2003 | Lin | |
| 2003/0183740 | A1 | 10/2003 | Knapp et al. | |
| 2003/0213888 | A1 | 11/2003 | Dicke et al. | |

* cited by examiner

CHILDREN'S RIDING DEVICE

CROSS-REFERENCE TO RELATED APPLICATION

This application claims the benefit of the filing date of U.S. Provisional Patent Application No. 60/815,939 filed Jun. 23, 2006, the disclosure of which is hereby incorporated herein by reference.

BACKGROUND OF THE INVENTION

The present invention relates to riding devices for children, and more particularly, to a riding device for children which allows for up and down bouncing movement, as well as side-to-side, front to back movement, or both.

The art of keeping children occupied and out of trouble is one only mastered by the most seasoned of parents, baby sitters or the like. One tool utilized by nearly every parent is the children's toy. If given the right toy, a child may be kept busy for hours, much to the delight of the persons caring for the child. Even a short walk through the toy section of any major department store will establish the importance and sheer size of the toy business. While ranging from dolls and action figures to detailed learning tools, there exist many toys to satisfy all children, no matter what age or skill level.

One area of toys that has always been a popular staple among children is the area of riding devices. Whether bicycles, big wheels, skate boards or pogo sticks, children typically enjoy operating different kinds of riding devices. However, there does not exist a vast amount of such devices for younger children or babies. While there are tricycles and walkers, among others, most devices are directed to older children or those who exhibit greater skill levels. This is often because such younger individuals cannot be trusted to operate small vehicles without direct supervision. As such, relatively stationary riding devices have been provided in place of such moving vehicles.

One example of such stationary riding devices would be the typical rocking or hobby horse. Such a toy typically allows for a young child to rock forward and back in a rudimentary simulation of horseback riding. However, such devices, although almost staples among younger children, are, in fact, rudimentary in operation and design. This is especially prevalent in our highly advanced society where lifelike simulations are common place. In addition, although some more realistic riding devices do exist, such are often complicated and not directed towards either domestic use or for mobility.

Therefore, there exists a need for a realistic children's riding device which both offers an authentic experience to a small child and lends itself to safe household use and relative portability.

SUMMARY OF THE INVENTION

A first aspect of the present invention is a riding device suitable for children or the like. In accordance with one embodiment, the device includes a seat portion, a base portion having a body and a connector providing a connection between the seat portion and the base portion. Preferably, the seat portion is capable of up and down bouncing motion and rocking motion with respect to the base portion.

In certain embodiments, the rocking motion may be forward and back rocking motion, side to side rocking motion, or both. The connector preferably facilitates the up and down and rocking motions. The body may further include textured stepping sections that aid a child or the like in mounting the device. The connector may, in some embodiments, include a first tubular member and a first spring disposed within a second tubular member to facilitate the up and down bouncing motion. The first tubular member may be at least partially disposed within the seat portion, and the first spring may be disposed between the seat portion and the base portion. The connector may also include a fulcrum rotatably mounted to the body of the base portion to facilitate the rocking motion. Such fulcrum may include at least one rounded surface for articulation with a rounded surface of the body of the base portion. Second and third springs may be provided between the fulcrum and the body of the base portion, and the fulcrum and body may include stops. The fulcrum may also include, in certain embodiments, a cup portion, a plug portion disposed within the cup portion, and an outer body portion connected to the plug portion. The cup portion may be rotatably mounted to the body of the base portion about a fulcrum point. The first tubular member may be connected to the plug portion. With regard to the seat portion, such may include a seat, stirrups and handlebars, and may be capable of providing audible or visual displays. Such displays may be actuated by buttons or other actuation devices located, for example, on the handlebars. Finally, the legs extending from the base portion may each be tubular shaped and each include a foot for contacting a surface contacted by the base portion.

An alternative embodiment of the present invention relates to a riding device. The riding device includes a base having a body, a fulcrum rotatably affixed to the body, and an actuating member affixed between the fulcrum and the body, wherein the actuating member is concealed within the body. The riding device also includes a seat portion, and a connection portion affixed at a first end thereof to the fulcrum and affixed at a second end thereof to the seat portion.

In a further embodiment, the base includes an outside surface and an interior cavity, an opening being formed in the outside surface to allow access to the interior cavity. Preferably, an upper portion of the fulcrum is disposed above the outside surface of the base and a lower portion of the fulcrum is disposed within the interior cavity of the base, the upper portion and lower portion being connected by a extension portion that passes through the hole in the outside surface of the base. The upper portion of the rocking mechanism may cover the hole in the outer surface of the base portion during rotation of the rocking mechanism. Additionally or alternatively, the lower portion of the rocking mechanism may cover the hole in the outer surface of the base portion during rotation of the rocking mechanism. Further preferably, the outside surface of the body is convex, and the upper portion of the fulcrum includes a lower surface that articulates with the outside surface of the body. Additionally or alternatively, the outside surface of the body may be located on a curved portion further having a concave inside surface, and the lower portion of the fulcrum may include an upper surface that articulates with the concave inside surface.

In a preferred embodiment, the first actuating member includes a first spring. The first spring may be disposed on a first side of the fulcrum, and the actuating member may further include a second spring disposed between the fulcrum and the body of the base on a second side of the fulcrum. In such an embodiment, the first and second springs preferably act together to urge the fulcrum toward an upright position. In one such embodiment the first spring and the second spring may be under compression when the fulcrum is in the upright position. Further, the base may be structured such that the first spring and the second spring are not under tension during movement of the fulcrum along a predetermined path.

In a further embodiment, the second end of the connector is moveable axially toward and away from the first end of the connector. The first end of the connector may be disposed on a lower portion of the connector and the second end of the connector may be disposed on an upper portion of the connector that is slideably engaged with the lower portion of the connector such that the second end is moveable axially toward and away from the first end. Preferably, a spring is disposed between the first and second ends of the connector.

In a still further embodiment, the fulcrum is rotatably affixed to the body of the base such that the fulcrum is capable of rotating in a front-to-back direction and a side-to-side direction.

Another alternative embodiment of the present invention relates to a riding device including a base having a rocking mechanism, the rocking mechanism including a first actuating member concealed within the base. The riding device further includes a connection portion having a bouncing mechanism, the bouncing mechanism having a second actuating member concealed within the connection portion. The riding device further includes a seat portion, wherein the connection portion is affixed at a first end thereof to the rocking mechanism and is affixed at a second end thereof to the seating portion.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
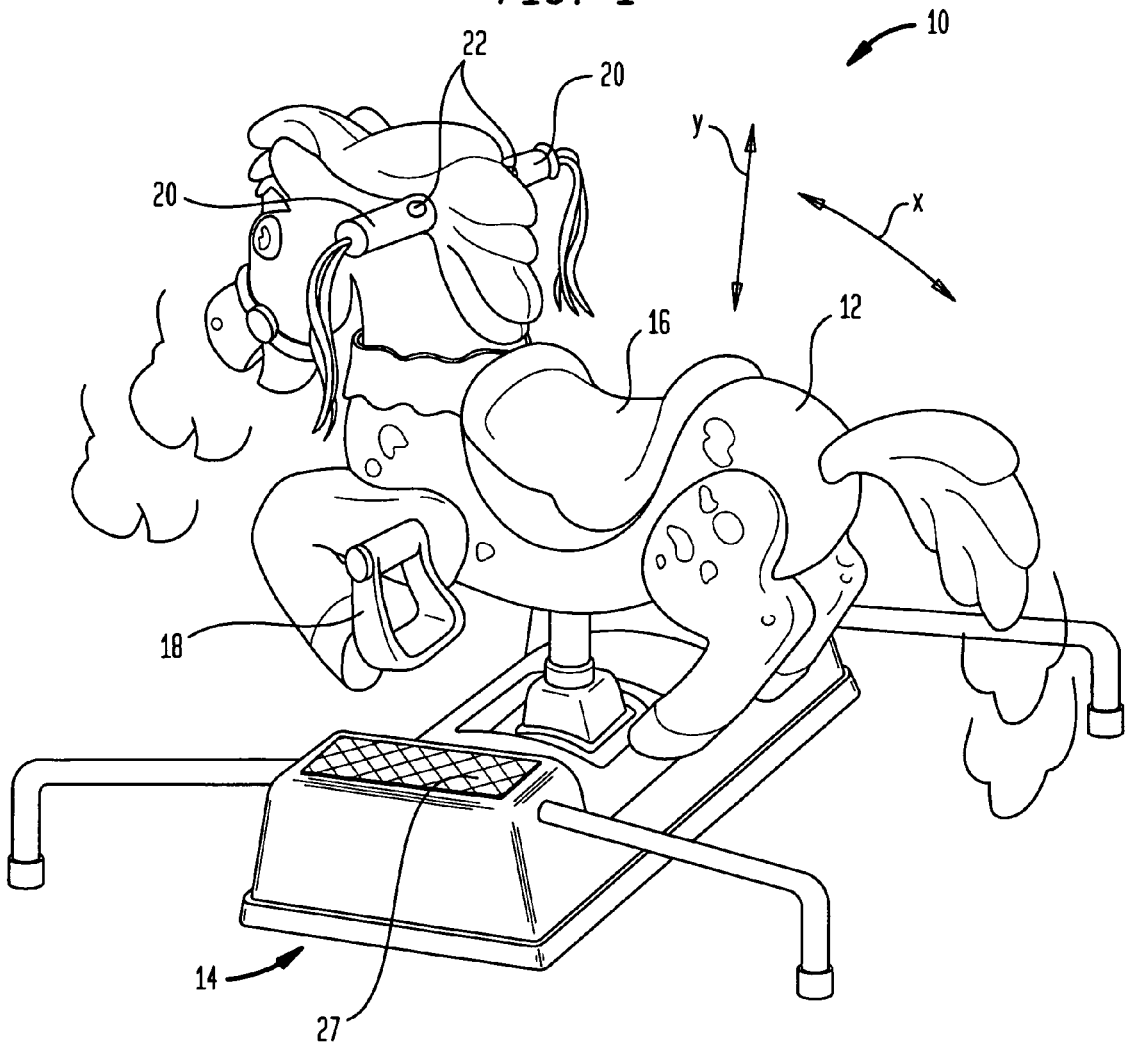
FIG. 1 is a perspective view of a riding device in accordance with one embodiment of the present invention.
Figure 2:
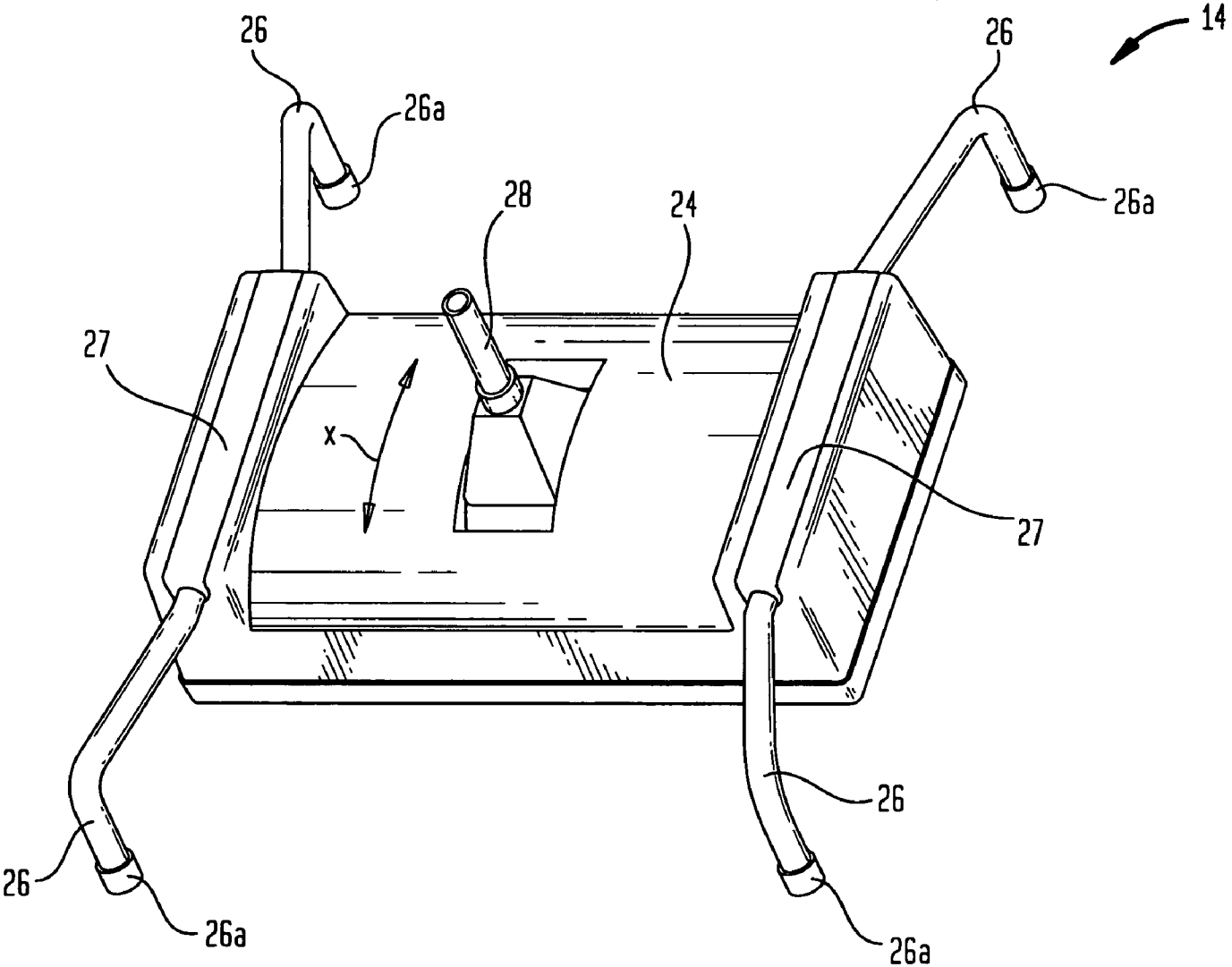
FIG. 2 is a perspective view of a base portion of the riding device of FIG. 1.
Figure 3:
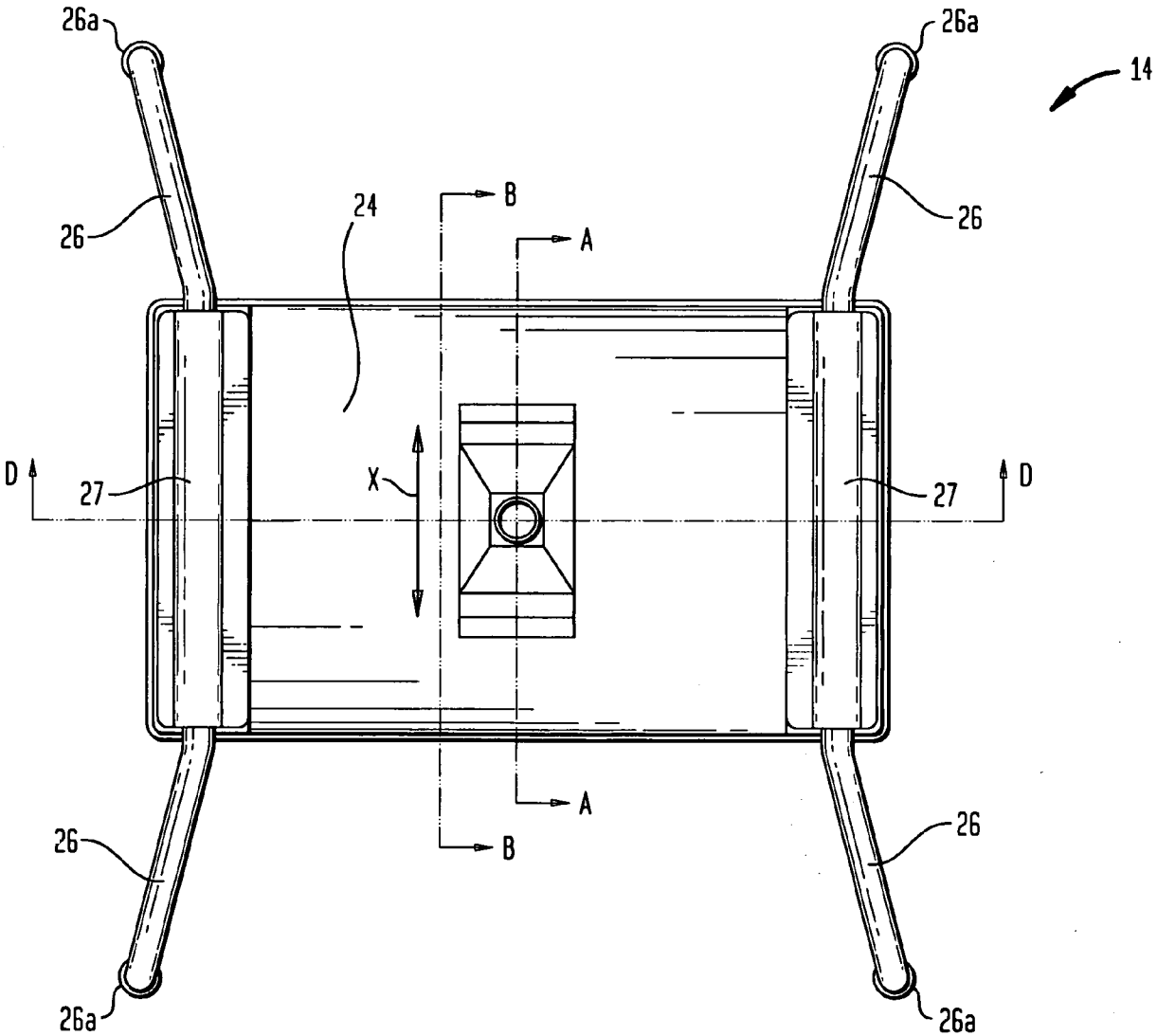
FIG. 3 is a top view of the base portion of FIG. 2.
Figure 4:
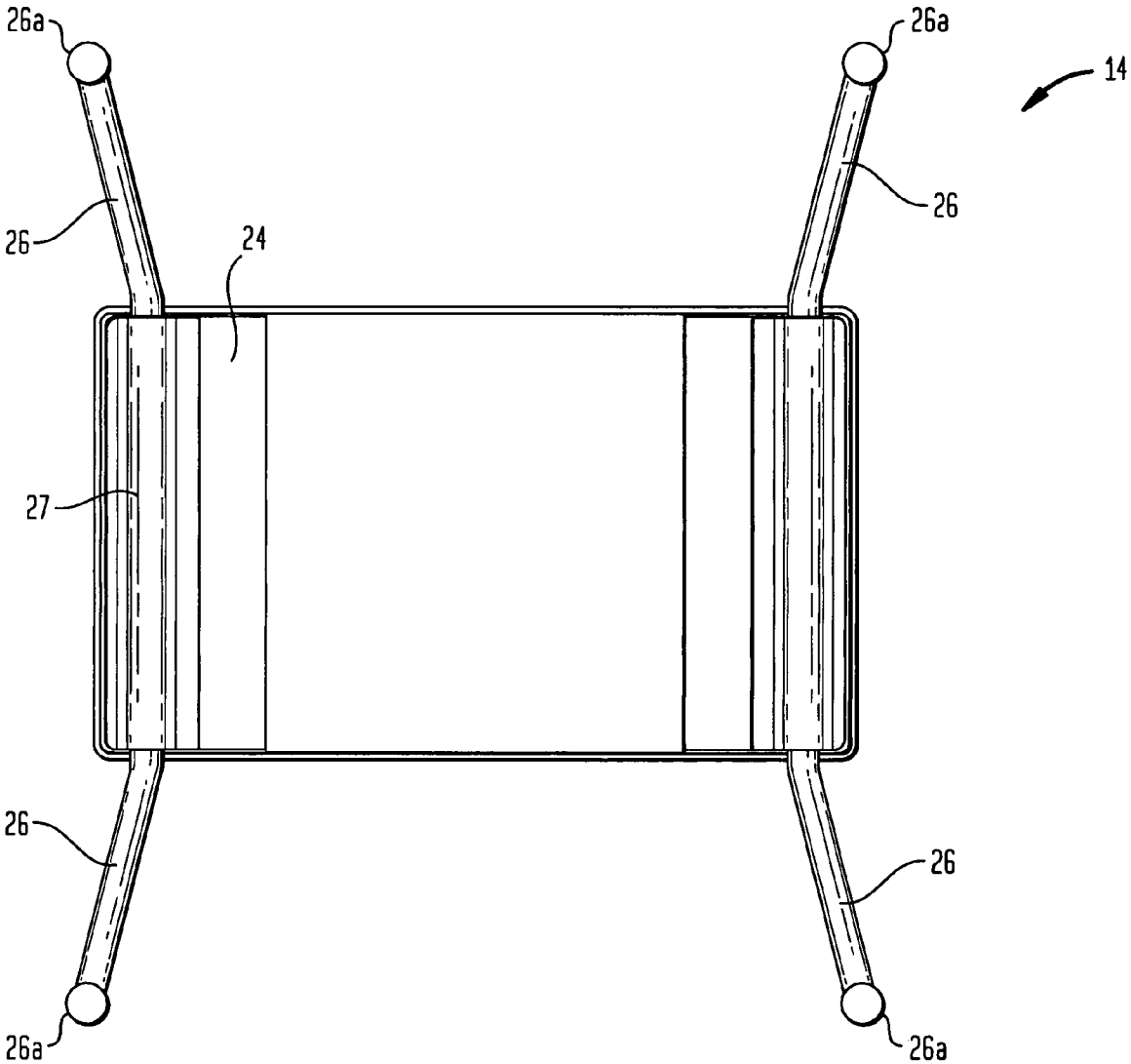
FIG. 4 is a bottom view of the base portion of FIG. 2.
Figure 5:
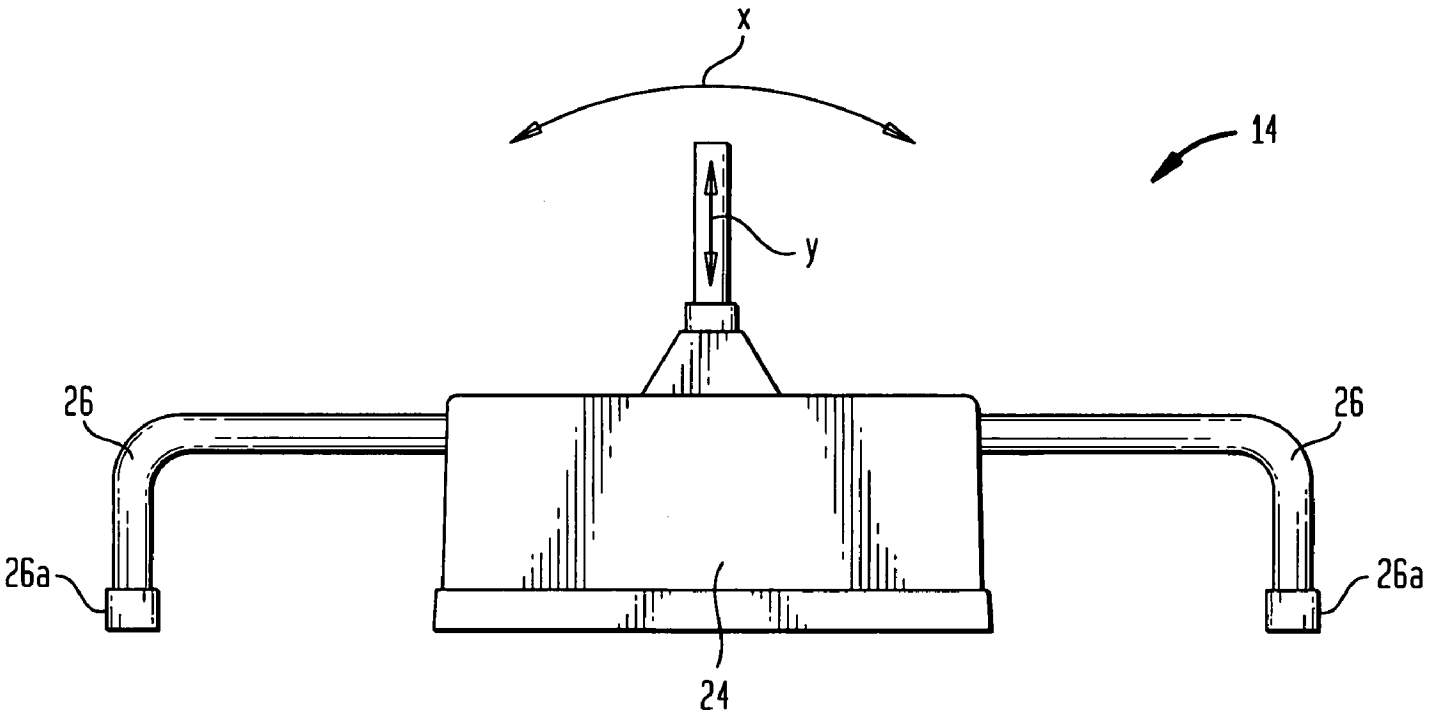
FIG. 5 is a side view of the base portion of FIG. 2.
Figure 6:
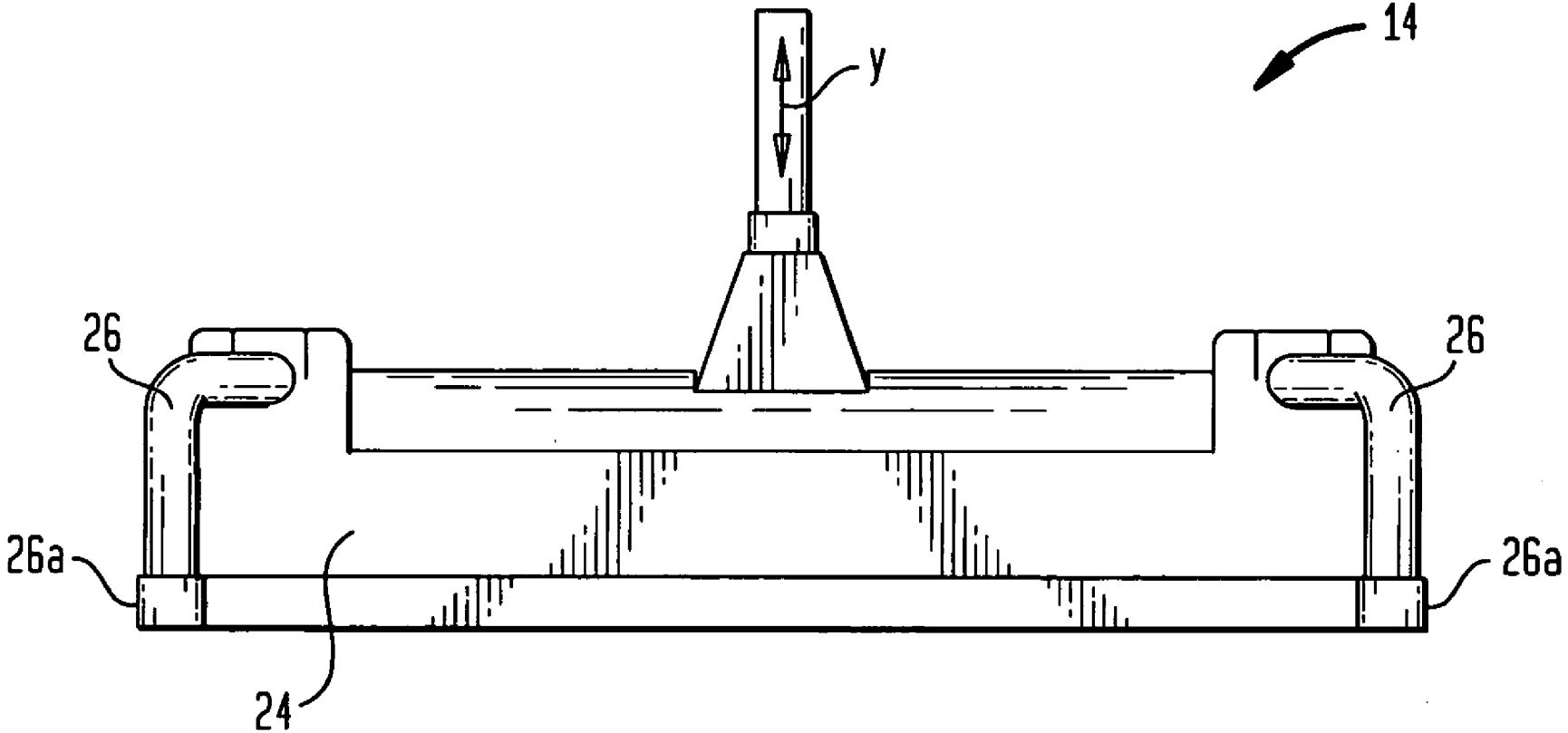
FIG. 6 is a front view of the base portion of FIG. 2.

Referring to the drawings wherein like reference numerals refer to like elements, there is shown in FIG. 1, in accordance with one embodiment of the present invention, a children's riding device or apparatus designated generally by reference numeral 10. In the embodiment shown in FIG. 1, riding device 10 preferably includes a seat portion 12 and a base portion 14, as well as the individual components which make up each of those portions. Such will be elaborated on further below. Although riding device 10 is shown and described below as being designed for use by a child, it is to be understood that other embodiment devices may be adapted for use by larger persons. In such cases, larger scale devices may simply be provided in order to accommodate larger individuals. Of course, larger scale devices will necessarily be more difficult to transport and therefore position. In addition, as will be further expounded upon below, device 10 can be provided so as to emulate many different imaginary experiences for a child. For example, while shown in the drawings as a device imitating the act of riding horseback, it is equally possible to provide other seat portions 12 which look or feel like different objects/animals.

As is best shown in FIG. 1 and briefly discussed above, seat portion 12 is configured so as to replicate a horse and the act of horseback riding. Although not exactly lifelike in its design, seat portion 12 basically exhibits characteristics present in rocking horse designs. For example, seat portion 12 includes a contoured seat 16, stirrups 18 and handles 20. In addition, seat portion 12 also preferably includes various elements/components (not individually numbered with reference numerals) that constitute and emulate the portions typically found in horses, such as a head, body, tail and legs. In whole, seat portion 12 ultimately forms a body which looks like a horse and is adapted for riding by a child. It is noted that seat portion 12 may be constructed of any suitable material, such as polymer or metal materials, or any others known in the art. Similarly, seat portion 12 may be manufactured assembled in accordance with any, suitable procedure or manufacturing method. For instance, it is contemplated to manufacture seat portion 12 in two left and right individual portions, and thereafter assemble such together to form the whole seat portion 12.

Seat portion 12 in and of itself preferably constitutes a relatively large body that may include one or more hollow areas or portions (not shown). Such hollow areas may be suitable for storage and seat portion 12 may further include one or more points to access such hollow areas. This may allow for storage of outside objects, such as other toys or blankets, or for the housing of electronic components used in conjunction with device 10. With regard to the former situation, a door or the like may be provided which allows for a child or other person to open same and insert outside objects. With regard to the latter scenario, it is noted that such electronic elements may provide for sounds and or voices to be derived from device 10. In the embodiment shown in FIG. 1, handlebars 20 include buttons 22 which may be actuated to cause such sounds or voices to be played. Systems suitable for creating and storing sounds and voices are well-know within the toy art and any such system may be employed in device 10. For example, a digital media player may be included which has several prerecorded tracked stored thereon (e.g., horse related sounds, etc.). Actuation of buttons 22 may cause different tracks (and thusly different audible materials) to be played. This may be done either randomly or in a predetermined order. It is noted that operation of one or the other of buttons 22 may cause different sounds to be played. In addition, it is envisioned that device 10 may be configured so that operation of buttons 22 could cause one or more visual indicators to become displayed, either in conjunction with the above-noted audible displays or separately. Such may include blinking or flashing lights, or the like.

As is mentioned above, seat portion 12 may take on other forms than that of the horse shown in FIG. 1. For example, seat portion 12 may be designed to imitate a manmade apparatus such as a car, police car, race car, truck, fire truck, spaceship, train, tractor, plane, jet, skateboard, surfboard, bicycle, motorcycle, or the like, or an animal/natural object such as a dog, cat, elephant, dinosaur, pony, fish, whale, dolphin or the like. Adapting seat portion 12 to emulate any of these things would be readily apparent to those of ordinary skill in the art, but should ultimately include portions similar to, seat 16, stirrups 18 and handlebars 20 for safe use by a child. Of course, certain of the above designs inherently may be safer than others. For example, embodiments employing an automobile-type design may provide for enclosures that may more safely house a child. In addition, it is worth noting that while discussed to this point as being a seat portion 12, such portion may be adapted to allow for the kneeling or standing by a child. Such designs may, of course, require different safety features. Finally, the particular design of seat portion 12 may dictate the desired motion of seat portion 12 with respect to base 14. This will be discussed more fully below.

Base portion or base 14 is shown without seat portion 12 in FIGS. 2-10. As is best shown in FIGS. 2-6, the exterior of base 14 preferably includes a body 24 and four extending legs 26. Body 24 is shown as being substantially rectangular, but may be many different shapes or sizes, which may be dictated by the aesthetic design of the apparatus. Legs 26 each preferably extend outwardly from body 24 so as to act as braces or stabilizers during use of device 10. The legs are shown as being extending tubular structures with feet 26*a* ultimately contacting a floor or other surface. It is noted that legs 26 may exhibit many different designs, and could be adapted for stabilizing device 10 on even or uneven surfaces by including movable sections. Both body 24 and legs 26 may be constructed of any suitable materials. For example, in one embodiment, body 24 is at least partially constructed of a polymeric material, while legs 26 are substantially metal with feet 26*a* being a rubber material. Other embodiments may include a body 24 and legs 26 being constructed of different materials. Device 10 may be heavier or lighter depending upon the material chosen and base 14 could be made to act as an anchor for the whole apparatus, if properly weighted. It is also worth noting that while shown in the figures as having four legs 26, base 14 may include any number of legs 26 as long as such operate to stabilize device 10.

Base portion 14 also preferably includes textured stepping portions 27 suitable for aiding a child in mounting seat portion 12 and a connector or connection 28 that allows for interconnection of seat portion 12 and base 14. In the embodiment shown in the drawings (best shown in FIGS. 2-6), connection 28 is essentially an elongate tubular structure capable of moving with respect to body 24 of base 14. Given that seat portion 12 is ultimately attached thereto, connection 28 provides seat portion 12 with similar movement capabilities. Specifically, in the embodiment shown in the figures, connection 28 is adapted to rock in a forward and back motion with respect to body 24, which is thusly attached to seat portion 12 to emulate a rocking horse type motion. This motion is depicted in the figures by arrow X. In addition, it is noted that connection 28 also preferably allows seat portion 12 to bounce up and down. This is also a motion consistent with horseback riding, and is illustrated in the figures by arrow Y.

The particular mechanism that allows for the motion depicted by arrows X and Y is more fully shown in the cross sectional views of FIGS. 7-10. First, with regard to the up and down motion illustrated by arrow Y, it is noted that connection 28 further includes a first tubular member 30 disposed within a second tubular member 32 of slightly larger inside diameter in a telescopic-like fashion. This arrangement allows the first and second members to slide relative to each other. Although shown as being tubular members with circular cross sections, first and second members 30 and 32 could exhibit other cross sectional shapes. In addition, first tubular member 30 includes a stop 34 which contacts a first spring 36 also disposed within second tubular member 32. During operation, first tubular member 30 is preferably allowed to move up and down within second tubular member 32, so that stop 34 acts upon spring 36. This movement may be imparted by a child seated upon seat potion 12. Preferably, spring 36 is designed so as to at least partially counteract such movement, so that, for example, a child bouncing upon seat portion 12 has the sensation of incurring bumpy terrain while on a horse or the like. Connection 28 also preferably includes a fulcrum portion 38 that includes a shoulder 40. While this fulcrum portion 38 will be discussed more fully below in relation to the forward and back rocking movement, it is worth noting here that shoulder 40 preferably prevents first tubular member 30 from being dislodged from second tubular member 32 during operation by engaging stop 34 upon full vertical motion. Thus, a child can bounce up and down on seat portion 12 without such becoming dislodged from base 14.

Figure 7:
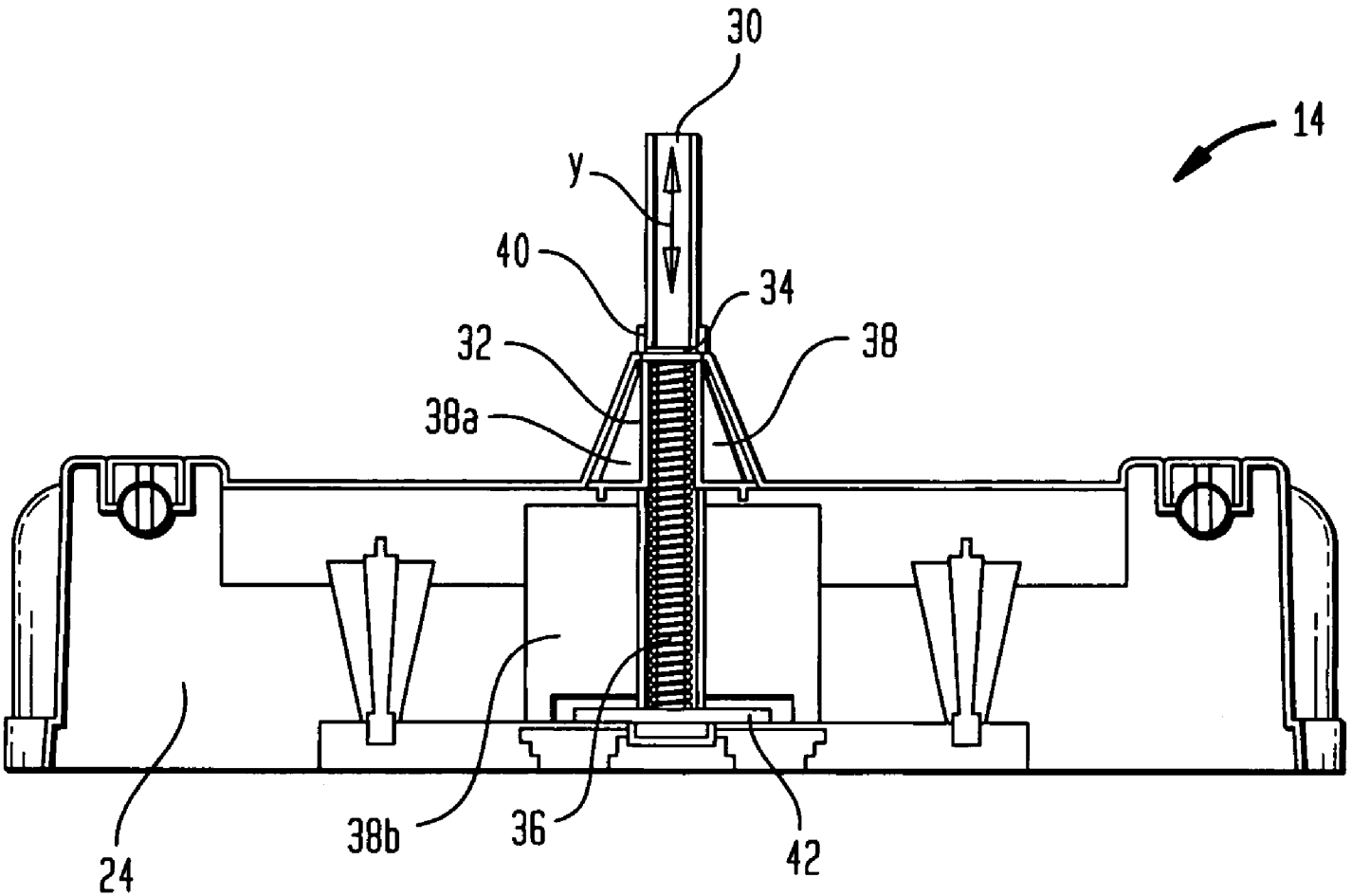
FIG. 7 is a cross sectional rear view of the base portion of FIG. 2, taken along line D-D of FIG. 3.
Figure 8:
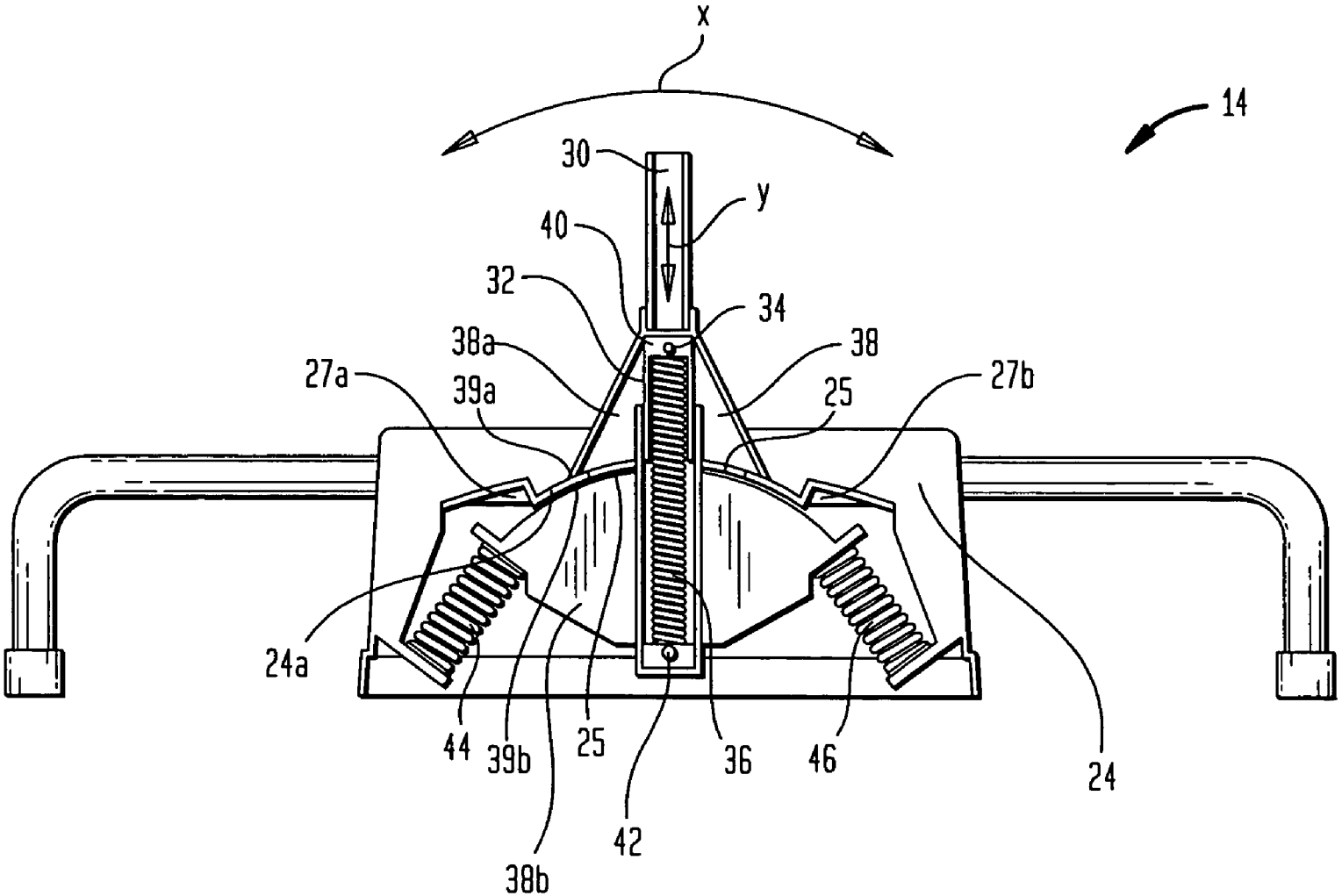
FIG. 8 is a cross sectional side view of the base portion of FIG. 2, taken along line A-A of FIG. 3.
Figure 9:
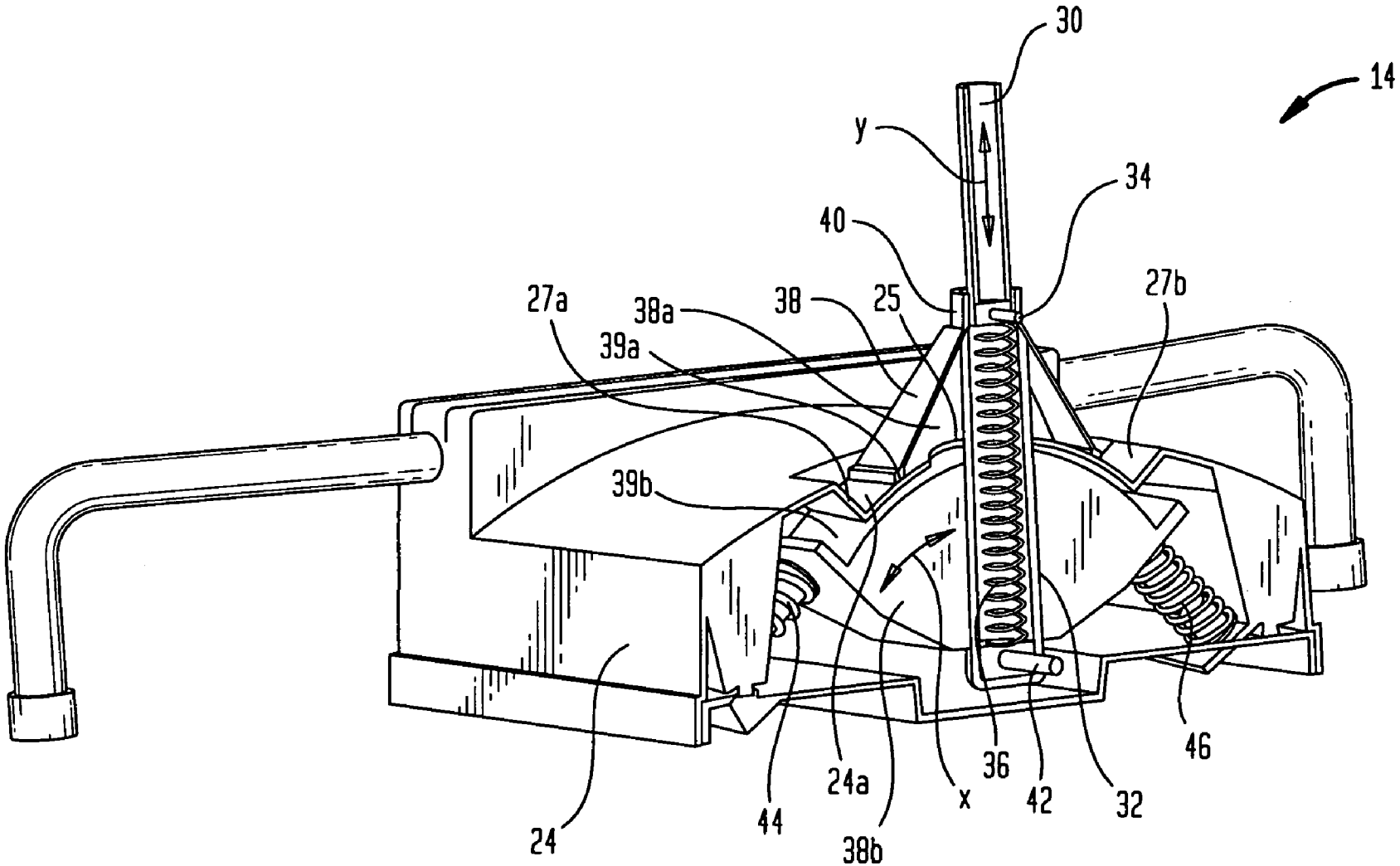
FIG. 9 is a cross sectional perspective side view of the base portion of FIG. 2, taken along line A-A of FIG. 3.

Fulcrum 38 is designed to accommodate the aforementioned forward and back rocking of seat portion 12 with respect to base 14. In this regard, fulcrum 38 is preferably rotatably coupled with body 24 about a fulcrum point 42 (best shown in FIGS. 7-9) and preferably includes a curved portion adapted to cooperate with a like curved portion within body 24. More particularly, fulcrum 38 preferably includes an upper portion 38*a* having an upper curved surface 39*a* and a lower portion 38*b* having a lower curved surface 38*b*. Preferably, upper curved surface 39*a* and lower curved surface 39*b* capture curved portion 24*a* of body 24. Second tubular member 32, which is captured within fulcrum 38, preferably extends through a hole or aperture 25 in curved portion 24*a* of body 24. This aperture 25 is preferably elongate so as to allow for the aforementioned rocking movement. All of these elements are best depicted in FIGS. 7-9. In addition, as is best shown in FIGS. 8 and 9, body 24 includes stop surfaces 27*a* and 27*b* which are engaged by portions of upper and lower curved portions 38*a* and 38*b* of fulcrum 38 upon complete rocking. These stops provide a stopping point so that a child can only rock so far. This may be considered a safety feature of the present invention, as the absence of such would theoretically allow rocking until seat portion 12 contacted a floor or other surface which base 14 is resting on, or would cause a portion of connection 28 to make contact with aperture 25. This latter situation could cause damage to body 24 depending upon the frequency or force of the contact. Finally, second and third springs 44 and 46 are preferably attached between fulcrum 38 and body 24 so as to provide a force which counteracts and controls the rocking motion of seat portion 12 with respect to base 24. In this regard, it is noted that both springs 44 and 46 may be any type of spring and are preferably configured so that they operate in opposite directions. In other words, taking the depiction of base 14 shown in FIG. 8, rocking of fulcrum 38 to the right will cause compression of spring 46 and extension of spring 44 and vice versa. In both cases, the springs preferably provide a force upon fulcrum 38 and counteract the movement provided by the child or other user.

Figure 10:
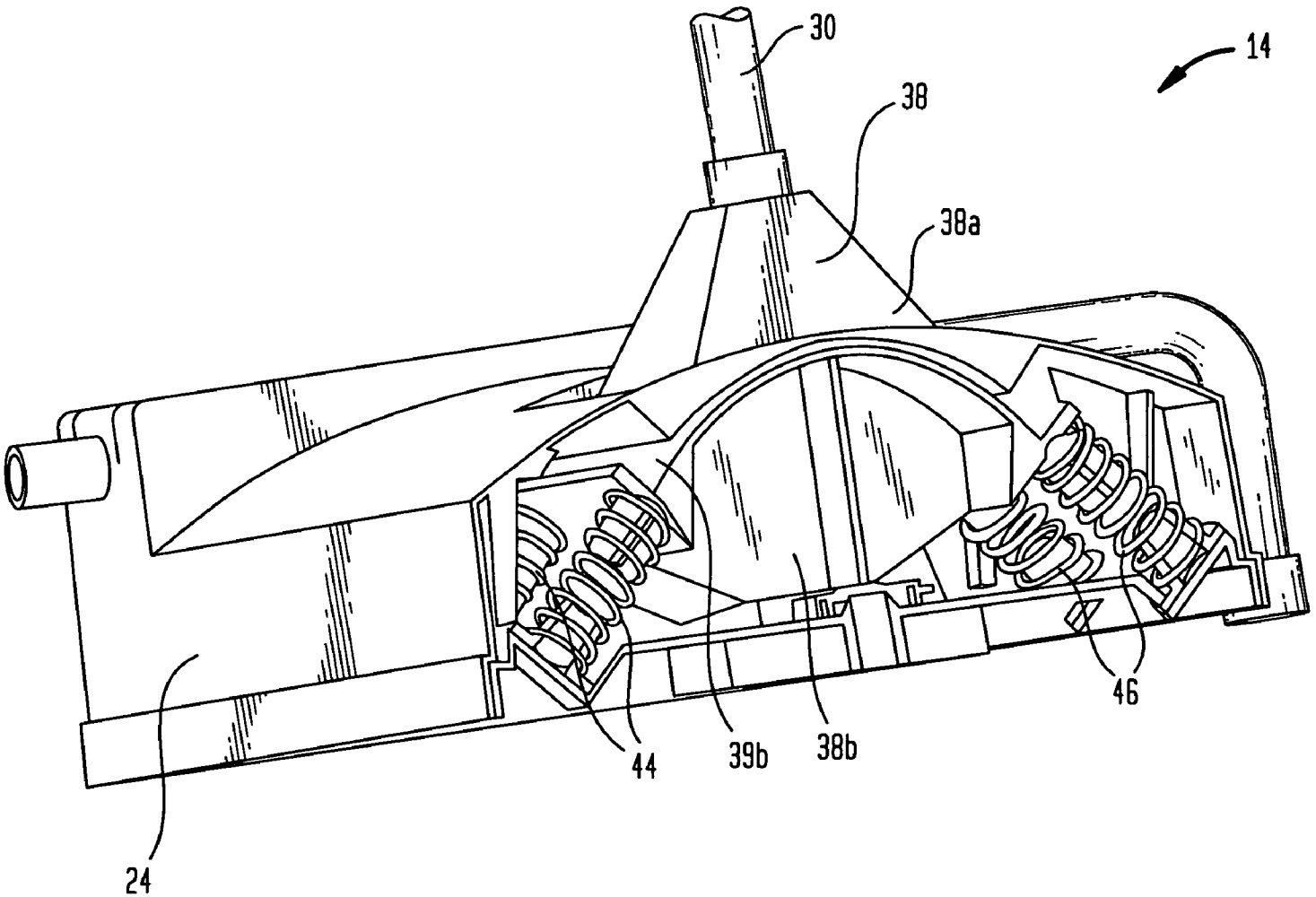
FIG. 10 is a cross sectional perspective side view of the base portion of FIG. 2, taken along line B-B of FIG. 3.

Therefore, the cooperation between connection 28 and body 24 preferably allows for the previously discussed up and down bouncing movement (arrow Y), as well as the forward and back rocking motion (arrow X). While shown in FIGS. 7-9 as being conical springs, each of springs 36, 44 and 46 may be any type of spring or other dampening or force transferring component, as long as such is designed to at least partially counteract the motion provided to seat portion 12 by a child or the like. Clearly, such spring properties may be designed with a particular size child and apparatus in mind. In addition, as is shown in FIG. 10, it is contemplated to provide a base 14 which employs multiple springs 44 and 46 for use in counteracting the forward and back rocking motion. Of course, multiple springs may also be applied to counteract the up and down bouncing motion of seat portion 12 with respect to base 14. For example, it is possible to provide one conical spring within another so such could fit within second tubular member 32. The determination of the amount or size of the springs employed in device 10 should be determined in light of the ultimate end use of the device.

As is alluded to above, it is contemplated to provide a device in accordance with the present invention which is capable of rocking or otherwise moving in any direction. Although shown in the figures and discussed in the foregoing description as being a rocking horse type device, which allows bouncing in an up and down direction, and rocking a forward and back direction, any combination of bouncing or rocking directions may be allowed. For example, in one embodiment where a seat portion is designed with an automobile or airplane in mind, it is preferably for such to be capable of not only bouncing up and down and rocking forward and back, but also rocking in a side to side fashion. In other words, a device in accordance with this embodiment would be capable of moving in almost any direction, in a similar fashion to a standard computer joystick. This is done so as to provide a more authentic ride for the rider. Of course, different types of devices may enable different movements.

Figure 11:
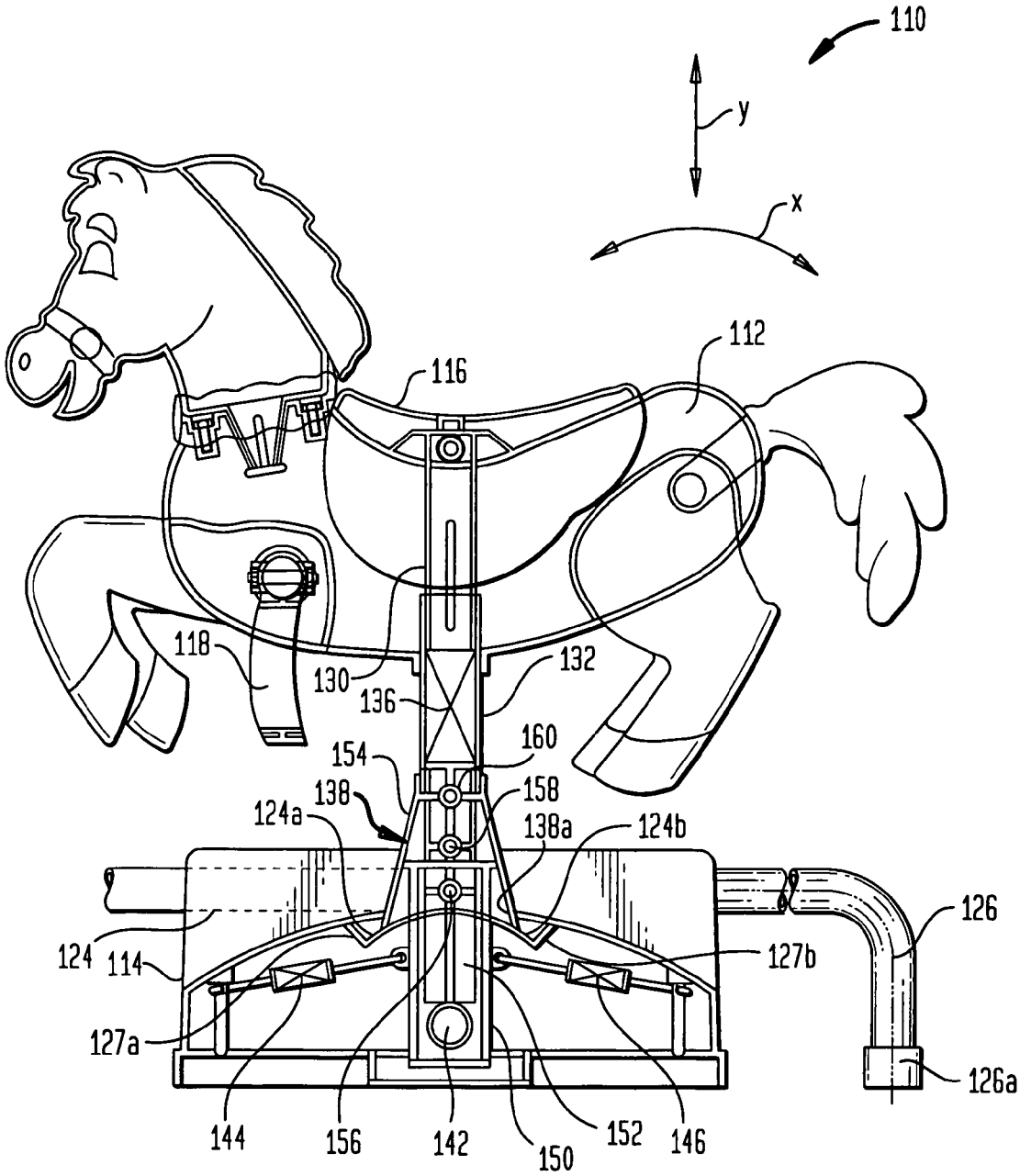
FIG. 11 is a partial cut away side view of a riding device in accordance with another embodiment of the present invention.
Figure 12:
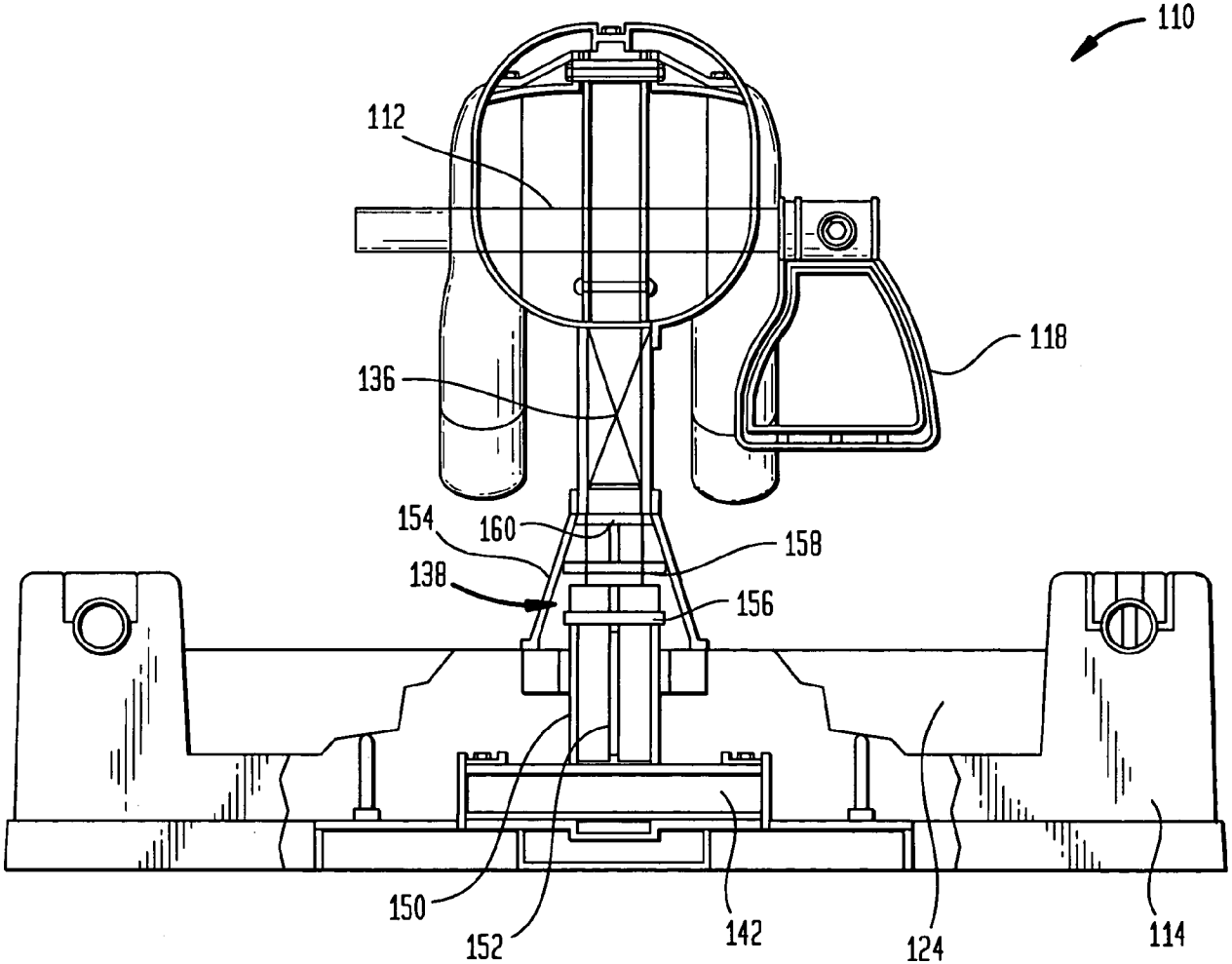
FIG. 12 is a partial cut away rear view of the riding device shown in FIG. 11.

Another embodiment of riding device is depicted in FIGS. 11 and 12, and will be referred to generally by reference numeral 110. Once again, device 110 relates to a rocking horse-type design and includes many similar if not identical elements to that of the above device 10. As such, like elements are referred to with similar reference numerals, but within the 100-series of numbers. For example, device 110 includes a seat portion 112 and a base portion 114. Device 110 essentially differs from device 10 in the specific configuration of its connection 128. More particularly, as is shown in FIGS. 11 and 12, device 110 makes use of a connector or connection 128 including a first spring 136 for aiding in the up and down bouncing movement of seat portion 112 with respect to base 114, and second and third springs 144 and 146 for aiding in the front to back rocking of seat portion 112 with respect to base 114. In both cases springs 144 and 146 are situated slightly different than in device 10.

Essentially, with regard to spring 136, such is similarly disposed within a second tubular member 132 and preferably acts upon a first tubular member 130. However, in device 110, second tubular member 132 extends further from a body 124 of base 114, and first spring 136 does not extend into body 124. Rather, the spring preferably extends in an area between seat portion 112 and base 114. In addition, first tubular member 130 is substantially disposed within seat portion 112, as opposed to that shown with respect to device 10. This preferably provides for a safer operation of device 110, as well as an easier device to manufacture. In a similar fashion, springs 144 and 146 are disposed within body 124 of base 114 in such a way that the forces which they respectively exert upon seat portion 114 are more efficiently displaced or provide stronger counter forces. Specifically, as is best shown in FIG. 11, springs 144 and 146 are situated in an orientation which is closer to a parallel orientation with respect to base 114, than that of springs 44 and 46 of device 10. This preferably allows for a more efficient use of the springs from an engineering standpoint, and may provide for a smoother rocking function. It is noted that springs 136, 144 and 146 are all shown generally in FIGS. 11 and 12, and can clearly take on any specific form. For example, such springs may be conical springs, leaf springs, or may include shock absorbers with piston elements or the like.

Also in the design of device 110, a fulcrum 138 is provided which only includes one rounded surface 138*a* for cooperating with a like rounded surface 124*a* of body 124. Similar to the above embodiment device 10, device 110 also includes stop surfaces 127*a* and 127*b* for stopping the rocking of the seat portion 112 in a similar fashion to the above. However, including only the single rounded surface 138*a* to articulate with surface 124*a* makes for the easier manufacturing and assembly of the device. In addition, fulcrum 138 includes several elements which may make assembling its cooperation with base 114 easier. Most notably, fulcrum 138 includes a cup portion 150 that is rotatably coupled with body 124 about fulcrum point 142, a plug portion 152 disposed within cup portion 150, and a outer body portion 154 (which includes the aforementioned rounded surface 138*a*) placed over plug portion 152.

The series of components that make up fulcrum 138 allow for cup portion 150 to be first rotatably connected to body 124 about fulcrum point 142, in a similar fashion as is discussed above. Thereafter, plug portion 152 may be placed therein and affixed thereto about point 156. This may be accomplished through the use of screws or the like. Next, outer body portion 154 and first tubular member 132 may be affixed to plug portion 152 about points 158 and 160 respectively, in a similar fashion to that of affixation about point 156. Of course, a different order of method steps may be followed in order to assemble fulcrum 138 and connect the other portions of device 110 thereto. Nonetheless, this fulcrum design coupled with the other design changes noted above, makes device 110 a more economically feasible design to create. Finally, the added safety imparted on device 110 by its particular design, and namely the different positioning of springs 136, 144 and 146, and tubes 130 and 132, makes for a safe device for operation by a child.

In view of all of the above, a useful and novel riding device for children is provided in accordance with the present invention. While only two specific embodiments are shown and discussed herein, it is clearly contemplated that other designs may exist. For example, the specific components of the designs shown herein may vary, thereby varying the overall operation of the device. In addition, the aesthetic design of the device may clearly vary, thereby conjuring up a different image for the child users. Nonetheless, the present invention is directed to a safe and enjoyable riding toy for use by a small child or the like.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A riding device comprising:

a seat portion;

a base portion having a body; and a connector providing a connection between the seat portion and the base portion, wherein said connector includes a fulcrum rotatably mounted to the body of the base portion, wherein the seat portion is capable of up and down bouncing motion and rocking motion with respect to the base portion.

2. The riding device of claim 1, wherein the rocking motion is forward and back rocking motion.

3. The riding device of claim 1, wherein the rocking motion is side to side rocking motion.

4. The riding device of claim 1, wherein the connector facilitates the up and down and rocking motions of the seat portion with respect to the base portion.

5. The riding device of claim 4, wherein the connector includes a first tubular member and a first spring slidably disposed within a second tubular member to facilitate the up and down bouncing motion.

6. The riding device of claim 5, wherein the first tubular member is at least partially disposed within the seat portion.

7. The riding device of claim 5, wherein a first spring is disposed between the seat portion and the base portion.

8. The riding device of claim 1, wherein the fulcrum includes at least one rounded surface for articulation with a rounded surface of the body of the base portion.

9. The riding device of claim 8, wherein the base portion further includes second and third springs connected between the fulcrum and the body of the base portion.

10. The riding device of claim 9, wherein the body of the base portion and the fulcrum include stops.

11. The riding device of claim 1, wherein the seat portion includes a storage compartment.

12. The riding device of claim 1, wherein the seat portion is capable of providing a sensory output.

13. The riding device of claim 12, wherein the displays are actuated by buttons included on a handlebar included on the seat portion.

14. The riding device of claim 1, wherein the base portion includes at least one textured stepping section.

15. The riding device of claim 1, wherein the rocking motion includes forward and back rocking motion and side to side rocking motion.

16. The riding device of claim 1, further comprising legs extending from the base portion.

17. The riding device of claim 16, wherein the legs each include a foot for contacting a surface contacted by the base portion.

18. A riding device, comprising;

a base including a body, a fulcrum rotatably affixed to the body, and an actuating member affixed between the fulcrum and the body, wherein the actuating member is concealed within the body;

a seat portion; and a connection portion affixed at a first end thereof to the fulcrum and affixed at a second end thereof to the seat portion.

19. The riding device of claim 18, wherein the base includes an outside surface and an interior cavity, an opening being formed in the outside surface to allow access to the interior cavity.

20. The riding device of claim 19, wherein an upper portion of the fulcrum is disposed above the outside surface of the base and wherein a lower portion of the fulcrum is disposed within the interior cavity of the base, the upper portion and lower portion being connected by a extension portion that passes through the hole in the outside surface of the base.

21. The riding device of claim 20, wherein the upper portion of the rocking mechanism covers the hole in the outer surface of the base portion during rotation of the rocking mechanism.

22. The riding device of claim 20, wherein the lower portion of the rocking mechanism covers the hole in the outer surface of the base portion during rotation of the rocking mechanism.

23. The riding device of claim 20, wherein the outside surface of the body is convex, and wherein the upper portion of the fulcrum includes a lower surface that articulates with the outside surface of the body.

24. The riding device of claim 20, wherein the outside surface of the body is located on a curved portion further having a concave inside surface and wherein the lower portion of the fulcrum includes an upper surface that articulates with the concave inside surface.

25. The riding device of claim 18, wherein the first actuating member includes a first spring.

26. The riding device of claim 25, wherein the first spring is disposed on a first side of the fulcrum, and wherein the actuating member further includes a second spring disposed between the fulcrum and the body of the base on a second side of the fulcrum, wherein the first and second springs act together to urge the fulcrum toward an upright position.

27. The riding device of claim 26, wherein the first spring and the second spring are under compression when the fulcrum is in the upright position.

28. The riding device of claim 27, wherein the first spring and the second spring are not under tension during movement of the fulcrum along a predetermined path.

29. The riding device of claim 18, wherein the second end of the connector is moveable axially toward and away from the first end of the connector.

30. The riding device of claim 27, wherein the first end of the connector is disposed on a lower portion of the connector and the second end of the connector is disposed on an upper portion of the connector that is slideably engaged with the lower portion of the connector such that the second end is moveable axially toward and away from the first end.

31. The riding device of claim 30, wherein a spring is disposed between the first and second ends of the connector.

32. The riding device of claim 31, wherein the fulcrum is rotatably affixed to the body of the base in a front-to-back direction and a side-to-side direction.

33. A riding device, comprising:

a base including a rocking mechanism, the rocking mechanism including a first actuating member concealed within the base, wherein said rocking mechanism includes a fulcrum rotatably mounted to said base;

a connection portion including a bouncing mechanism, the bouncing mechanism including a second actuating member concealed within the connection portion; and a seat portion;

wherein the connection portion is affixed at a first end thereof to the rocking mechanism and is affixed at a second end thereof to the seating portion.

34. A riding device comprising:

a seat portion;

a base portion having a body; and a connector assembly providing a connection between the seat portion and the base portion, said connector assembly including a cup portion having first and second ends, said first end of said cup portion rotatably coupled to said body about a point of rotation, a plug having first and second ends, said first end of said plug secured to said second end of said cup portion, a first tubular member having first and second ends, said first end of said first tubular member secured to said second end of said plug, a second tubular member having first and second ends, said first end of said second tubular member telescopically received within said second end of said first tubular member, said second end of said second tubular member coupled to said seat portion, and a spring positioned within at least one of said first and second tubular members;

wherein the seat portion is capable of up and down bouncing motion and rocking motion with respect to the base portion.

* * * * *